US006053378A

United States Patent [19]

Doyel

[11] Patent Number: 6,053,378

[45] Date of Patent: Apr. 25, 2000

[54] CLOSET SPACE SAVER

[76] Inventor: John S. Doyel, 404 W. 20th St., New York, N.Y. 10011

[21] Appl. No.: 09/261,544

[22] Filed: Mar. 3, 1999

[51] Int. Cl.[7] ..... A47G 25/14; A47G 25/60

[52] U.S. Cl. ..... 223/86; 223/DIG. 2; 223/DIG. 4; 211/113

[58] Field of Search ..... 223/85, DIG. 9, 223/DIG. 1, 87, 86; 40/322; 211/113

[56] References Cited

U.S. PATENT DOCUMENTS

| | | | |
|---|---|---|---|
| D. 93,143 | 8/1934 | Spragg | 223/DIG. 1 |
| D. 167,986 | 3/1952 | Jonaitis . | |
| D. 200,224 | 2/1965 | Manaster . | |
| D. 237,852 | 12/1975 | Aron . | |
| D. 297,284 | 8/1988 | Campbell . | |
| 1,005,870 | 10/1911 | Packer . | |
| 2,265,789 | 12/1941 | Vivaudou et al. | 223/86 |
| 2,514,742 | 11/1950 | Burger et al. . | |
| 2,709,005 | 5/1955 | Eckstein . | |
| 3,900,110 | 8/1975 | Soroka . | |
| 4,709,838 | 12/1987 | Campbell . | |
| 5,072,837 | 12/1991 | Rösch . | |
| 5,107,996 | 4/1992 | Whittaker . | |
| 5,265,737 | 11/1993 | Freeby . | |
| 5,405,065 | 4/1995 | Olson | 223/DIG. 4 |
| 5,582,334 | 12/1996 | Blazer et al. . | |
| 5,586,697 | 12/1996 | Johannson | 223/85 |
| 5,881,931 | 3/1999 | Stanfield | 223/85 |

*Primary Examiner*—Bibhu Mohanty
*Attorney, Agent, or Firm*—Cooper & Dunham LLP

[57] ABSTRACT

A closet space saver molded as a single, unitary piece of a plastic material and hangs from a closet rod from a rod hook that is sufficiently wide to stabilize the device and keep it from undue side-to-side rocking. A V-shaped portion with open-sided slots hangs below the rod hook so that the hooks of coat hangers can be inserted into the slots from the side. The wide rod hook has an opening therein formed in a molding operation that makes it possible to mold the closet space saved in a single closing and opening of a the mold but without the use of cams. Attachments made of or containing a fragrant substance can be removably attached to the closet space saver to provide a pleasing fragrance and/or inhibit insects.

12 Claims, 5 Drawing Sheets

CLOSET SPACE SAVER

FIELD

The disclosed device is in the field of garment hanger supports for use in closets.

BACKGROUND

A number of devices have been proposed to help reduce the space that garments take up in a closet. One approach has been to support coat hangers in vertically spaced positions. For example, devices have been proposed that hang from a normal closet rod and in turn support ordinary coat hangers in a vertically staggered arrangement, as in U.S. Pat. Nos. 5,582,334 and 2,514,742. Other devices for supporting coat hangers in a staggered arrangement are proposed in U.S. Pat. Nos. 5,107,996, 5,072,837, 4,709,838, 2,709,005 and Des. 297,284. Devices that have some similarities but support other articles are proposed in U.S. Pat. Nos. 5,265,737, 3,900,110, 1,005,870 and Des. 200,224 and 167,986. Said U.S. Pat. No. 5,582,334 proposes making the device out of an insect inhibiting material (cedar).

While the known proposal may save closet space, it is believed that they have a number of deficiencies. The device disclosed in this patent specification is designed to overcome such deficiencies and prove added conveniences.

SUMMARY

The closet space saver disclosed in this patent specification is integrally molded into a single piece of material, and comprises a rod hook for hanging on a typical closet rod. A V-shaped portion extends down from the rod hook and has slots along its sides into which the hooks of coat hangers (or other items) can be inserted sideways.

The rod hook is wide, to provide structural strength and also to engage a significant length of the closet rod and thereby stabilize the closet space saver when hanging from a closet rod and keep it from rocking unduly from side to side as coat hangers are loaded onto it. The V-shaped portion is generally flat, to save on material, but both it and the rod hook have stiffening ribs of flanges providing structural strength. The slots along the sides of the V-shaped portion are open sided, whereby the user can load coat hangers onto the closet space saver from the left or the right, with the garments naturally stacking one upon the other in a vertically staggered arrangement. The accentuated V-shape helps stagger the garments horizontally as well as vertically.

A fragrant attachment can be removably secured to the front and/or the back of the closet space saver, such as an attachment comprising one or more discs of (or containing) a fragrant material, e.g., cedar, or comprising one of more containers of another fragrance, or some combination thereof. The manner of fastening the attachment permits convenient adding or removing of attachments or portions thereof. The attachment are positioned relative to the closet space saver in a manner that enhances the benefits of the fragrance. The fragrant material can be a molded plastic material containing a fragrance. For example, a fragrance can be added to material such as granules or powder of a plastic such as polyethylene, or to a liquid form of the plastic, and molded into a disc or some other suitable form of an attachment.

The shape and size of the disclosed closet space saver make it particularly convenient to use. For example, the wide rod hook helps keep the device stable, the open-sided slots and the accentuated V-shape make it possible to load and remove coat hangers to or from any place in the staggered stack of garments without unduly disturbing other garments in the stack, and the attachments make it possible to add varying amounts of fragrance sources, to use different fragrances at the same time or at different times, and to replace fragrance sources. No rearrangement or unfolding of the space saver is required in order to add garments to the disclosed closet space saver or to remove garments from it.

The rod hook is in the shape of a curved band of generally flat material (with stiffening ribs of flanges along the periphery) but has a sizeable hole that makes it possible to mold the closet space saver as a single piece in a single closing and opening of a mold that does not suffer from the added expense of a cam, despite the fact that the mold opens and closes in a direction normal to the plane of the V-shaped portion and the rod hook axis is parallel to that plane.

In addition to, or instead of coat hangers, items such as bags, belts, purses, hats, caps, scarves, etc. can be secured to the disclosed closet space save.

The V-shape of the closet space saver can be made more pronounced (i.e., the angle of its sides can be increased, e.g., to 90° or even more) in order to increase the lateral spacing of the slots in the sides and thereby make it even easier to remove or add items without disturbing other items secured to the disclosed closet space saver.

DETAILED DESCRIPTION OF PREFERRED EMBODIMENTS

Figure 4:
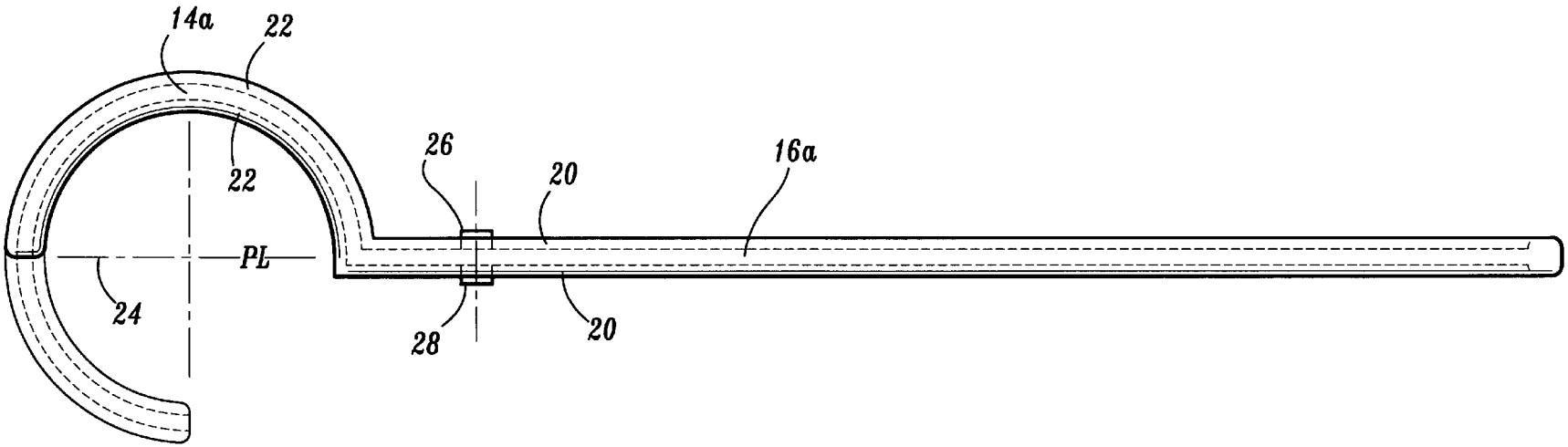
FIG. 4 is a side view of the closet space saver.
Figure 5:
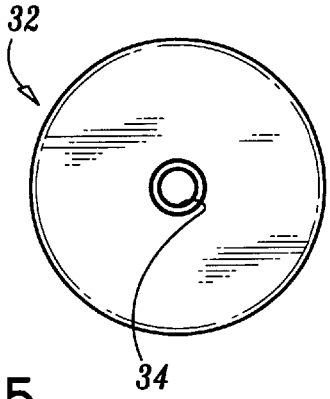
FIG. 5 is a plan view of an attachment.

A closet space saver 10 hangs from a typical closet rod 12 by a rod hook 14 such that a V-shaped portion 16 extends down, with open-sided slots 18 along its sides, each slot 18 shaped and dimensioned to accept the hook of a typical coat hanger inserted therein from the respective side. The central part 16*a* of V-shaped portion 16 is generally flat and thin and is sheet-like, but a stiffening rib or flange 20 surrounds it to add structural strength. As seen in FIGS. 4 and 5, rib or flange 20 is symmetric relative to the thin and flat central part of V-shaped portion 16 both in plan view and in side view. Rod hook 14 also has a thin sheet-like but curved central part 14*a* surrounded by a stiffening rib or flange 22 that is symmetrical with respect to part 14*a* in side view. In addition, rod hook 14 has an opening 14*b* that makes it possible to mold closet space saver 10 in a single closing and opening of a mold that does not use a cam. The mold opens at plane 24 (FIG. 4). Thus, the portion of rod hook 14 that is at and near the free end thereof can be molded by being bounded on the bottom (in the orientation of FIG. 4) by a cavity in the lower part of a mold and on the top by a plunger coming down from the top part of the mold, with the plunger forming opening 14*b*. The plunger need not move relative to the upper part of the mold, whereby closet space saver can be molded without using a cam that moves relative to both halves of the mold, despite the fact that rod hook 14 curves in a way that wold not otherwise allow molding without adding the expense of a cam to making a mold.

Figure 6:
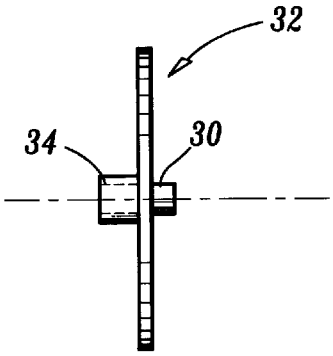
FIG. 6 is a side view of the attachment.
Figure 7:
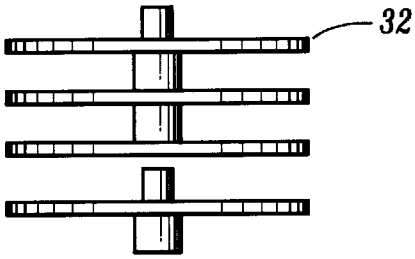
FIG. 7 illustrates a stack of attachments secured to each other.

Ferrules of sockets 26 and 28 are molded as a part of V-shaped portion 16, one on each side, to accept in a friction fit a projection 30 (FIGS. 5 and 6) of an attachment 32 that is a disc-shaped piece of fragrance impregnated plastic and has at its other side a ferrule or socket 34 identical to ferrules or sockets 26 and 28. A user can removably secure an attachment 32 to either or both of ferrules or sockets 26 and 28 by friction-fitting projection 30 therein, and can secure another attachment 32 to the one already secured by friction-fitting projection 30 of the second attachment into the ferule or socket 34 of the first one. Any practical number of attachments 32 can be secured one to the other in this manner, at one or at both sides of V-shaped portion 16. A stack of attachments 32 can be secured to each other as illustrated in FIG. 7, and such a stack can be secured to one or both sides of V-shaped portion 16.

Ferrules or sockets 26 and 28 are shaped and dimensioned such that the major portion of attachment 32 is spaced from flat part 16 of V-shaped portion 16, to allow air flow V-shaped portion 16 and attachment(s) 32 closes to it. Similarly, ferrule or socket 34 on attachment 32 is shaped and dimensioned to space from each other the major portions of two attachments 32 secured to each other and allow air flow between them. Such air flow enhances the fragrance that attachment(s) 32 provide.

Figure 1:
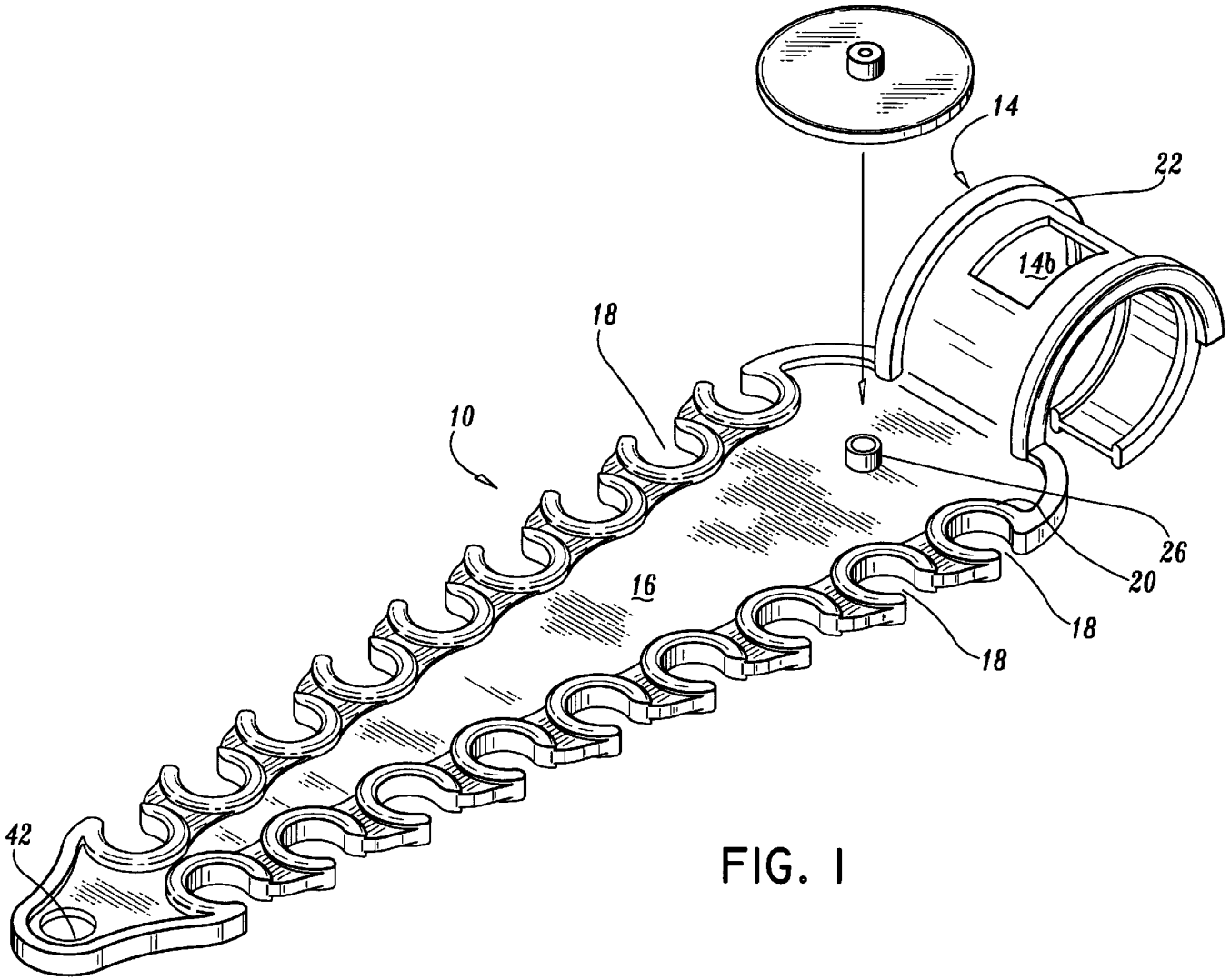
FIG. 1 is an isometric view of a closet space saver and a fragrant attachment.
Figure 2:
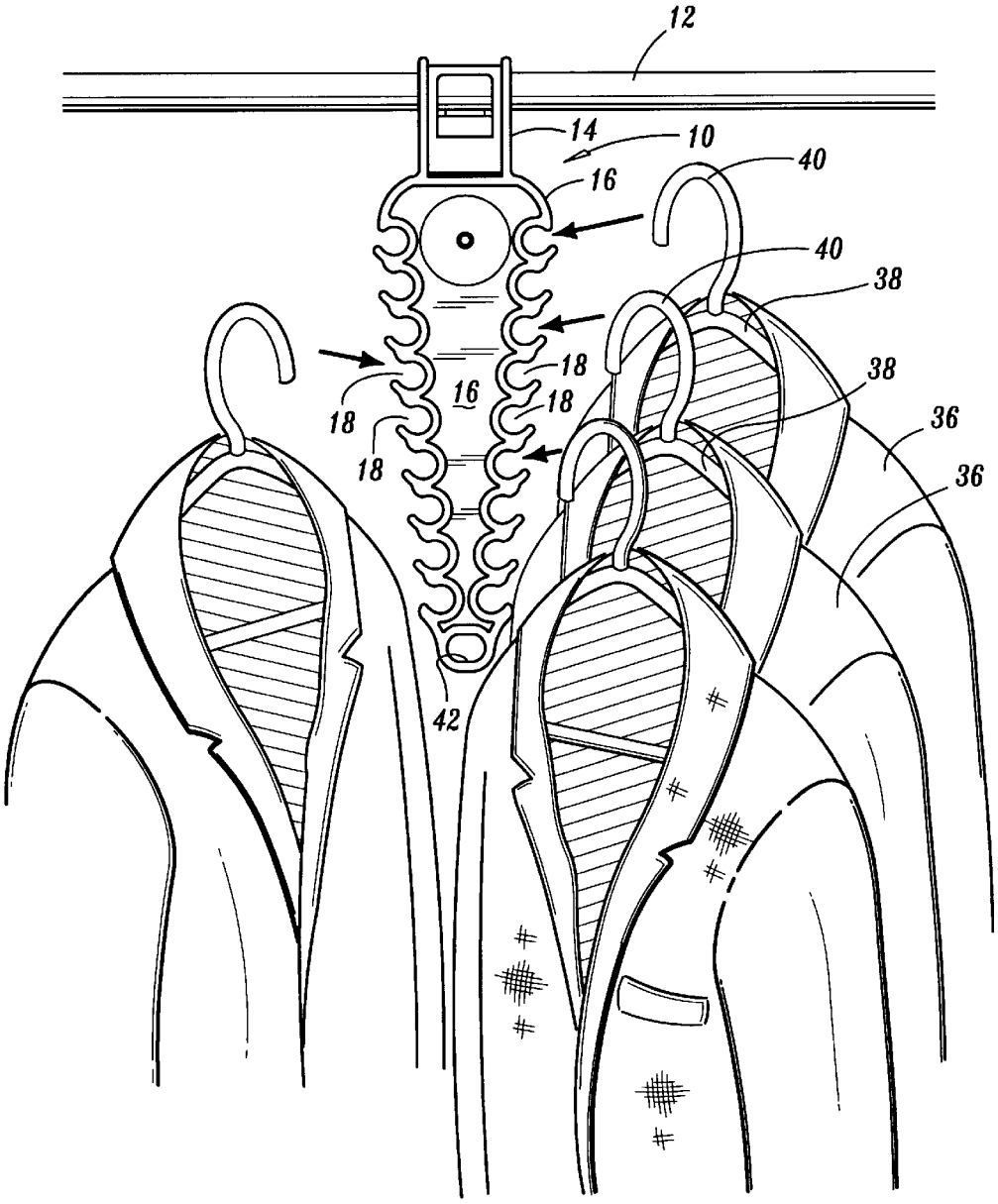
FIG. 2 is a front view of the closet space saver hanging from a closet rod and an isometric view of garments on hangers.
Figure 3:
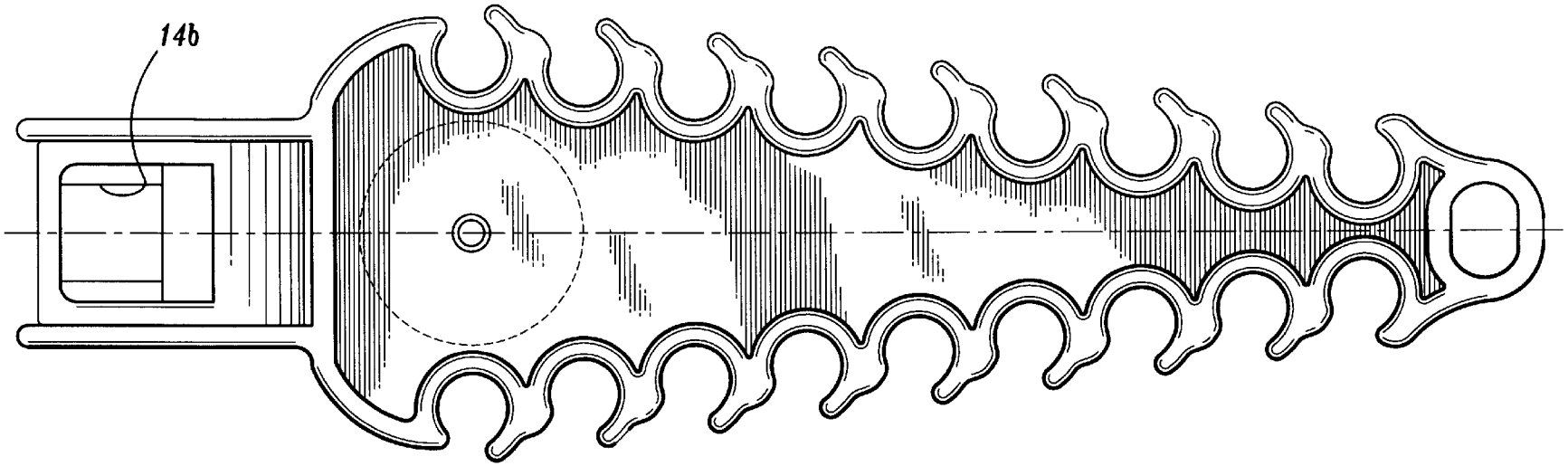
FIG. 3 is a plan view of the closet space saver.

As illustrated in FIG. 2, a user hangs closet space saver 10 on a closet rod 12 and hangs one or more garments 36 on respective coat hangers 38 by inserting the hook 40 of the respective coat hanger into a selected slot 18 from the respective side of V-shaped portion 16. Another garment can hang on a coat hanger 38 whose hook is inserted in a central opening 42 at the lower end of closet space saver 10.

Rod hook 14 is wide, to stabilize closet space saver 10 both when garments are being loaded thereon or unloaded therefrom and when closet space saver 10 is being placed in a closet or is simply hanging in a closet. Rod hook 14 is preferably close to or more than an inch wide, and more preferably two or three inches wide, to help keep closet saver 10 stable and keep it from rocking from side to side in use.

If additional structural strength is desired, stiffening ribs (not shown) can be molded in the same molding operation onto the sheet-like portions 14*a* and/or 16*a*, at one or both sides thereof. Instead of or in addition to fragrance impregnated plastic discs 32, attachment that are shaped differently and/or are made of a different material can be provided, and/or containers for material that have similar projections 30 and ferrules or sockets 34. Such containers can be for material such as cedar shavings or moth-balls or crystals or another insect-inhibiting substance or a substance that emits a pleasing fragrance.

While the text above and the drawings illustrate particular preferred embodiments, it should be clear that the scope of the invention is not limited thereto but encompasses all modifications that are within the scope of the claims set forth below.

I claim:

1. A closet space saver for hanging from a closet rod comprising:

an elongated body having a rod hook at one end and a flat portion extending away therefrom along the length of the body, said rod hook and flat portion being integrally molded as a unitary, single piece of material;

said rod hook being configured to engage a closet rod and being at least an inch wide along the length of the closet rod to help keep the closet space saver from rocking to the left or right when coat hangers are being loaded thereon or removed therefrom;

wherein said hook has an opening facing a closet rod when the closet space saver hangs therefrom, said opening being at a curved portion of the rod hook and configured for molding the closet space saver in a single closing and opening of a mold that has no cam;

said flat portion being generally parallel to the closet rod axis and tapering in a direction away from the hook and having a left side and a right side extending along the length thereof and defining respective columns of slots, with the slots at the left side being open to the left and the slots along the right side being open to the right; and each of said slots being shaped, dimensioned and oriented to accept a coat hanger hook inserted therein from the left for the slots at the left side of the flat portion and from the right for the slots at the right side of the flat portion so the coat hanger extends in a direction transverse to the length of the closet rod.

2. A closet space saver as in claim 1 in which said ferrule and appendage projection space a major portion of the appendage from said V-shaped portion to allow for the flow of air therebetween.

3. A closet space saver as in claim 1 in which the slots in the V-shaped body are symmetrical with respect to a plane bisecting the unitary body and normal to the left-right direction.

4. A closer space saver as in claim 1 in which said rod hook is at least one inch wide.

5. A closet space saver comprising:

an elongated body having a rod hook at one end and a flat portion extending away therefrom along the length of the body, said rod hook and flat portion being integrally molded as a unitary, single piece of material;

said flat portion having a left side and a right side extending along the length thereof and defining respective columns of slots, with the slots at the left side being open to the left and the slots along the right side being open to the right;

each of said slots being shaped, dimensioned and oriented to accept a coat hanger hook inserted therein from the left for the slots at the left side of the flat portion and from the right for the slots at the right side of the flat portion;

said rod hook being shaped and dimensioned to engage a closet rod and being at least an inch wide along the length of the closet rod to help keep the closet space saver from rocking to the left or to the right when coat hangers are being suspended therefrom.

6. A closet space saver as in claim 4 in which said rod hook comprises an opening taking up at least half the width of the rod hook.

7. A closer space saver as in claim 4 including an appendage comprising a fragrant material and respective fasteners on said flat portion and said appendage removably securing the appendage to said elongated body while allowing air flow therebetween.

8. A closet space saver as in claim including a fastener forming a part of said integrally molded elongated body and a scent-emitting attachment having a fastener removably engaging with the fastener on the elongated body to secure the attachment thereto.

9. A closet space saver as in claim 8 in which said fasteners space the attachment from the elongated body to allow for air flow therebetween.

10. A closer space saver configured to hang from a closet rod and comprising:

a rod hook and an elongated, flat portion extending therefrom, said flat portion being generally parallel to the length of the closet rod when the closet space saver is hanging therefrom;

said rod hook and flat portion being a single, unitary, integrally molded piece of material formed in a molding operation using a single closing and opening of a mold that does not use a cam;

said rod hook and flat portion having stiffening flanges along sides thereof that are spaced from each other along the length of the closet rod when the closet space saver is hanging therefrom;

said rod hook being shaped, dimensioned and oriented to engage a closet rod so the closet space saver hangs therefrom; and said rod hook having an opening between flanges thereof that are spaced from each other along the length of the closet rod so that the opening faces the closet rod when the closet space saver hangs therefrom.

11. A closet space saver as in claim 10 wherein said flat portion tapers away from the rod hook.

12. A closet space saver as in claim 10 wherein said flat portion is V-shaped.

* * * * *